US010335667B2

(12) United States Patent
Martinez Almansa et al.

(10) Patent No.: US 10,335,667 B2
(45) Date of Patent: Jul. 2, 2019

(54) REMOVABLE ASSEMBLY FOR A SKATEBOARD

(71) Applicant: DRYSURF, S.L., Irun, Gipuzkoa (ES)

(72) Inventors: Juan Martinez Almansa, Gipuzkoa (ES); Luis Parras Anguita, Gipuzkoa (ES)

(73) Assignee: DRYSURF, S.L., Gipuzkoa (ES)

( * ) Notice: Subject to any disclaimer, the term of this patent is extended or adjusted under 35 U.S.C. 154(b) by 0 days.

(21) Appl. No.: 15/736,723

(22) PCT Filed: Jun. 8, 2016

(86) PCT No.: PCT/ES2016/070430
§ 371 (c)(1),
(2) Date: Dec. 14, 2017

(87) PCT Pub. No.: WO2016/203076
PCT Pub. Date: Dec. 22, 2016

(65) Prior Publication Data

US 2018/0193721 A1 Jul. 12, 2018

(30) Foreign Application Priority Data

Jun. 15, 2015 (ES) ..... 201530827

(51) Int. Cl.
*A63C 17/00* (2006.01)
*A63C 17/01* (2006.01)

(52) U.S. Cl.
CPC ..... *A63C 17/0093* (2013.01); *A63C 17/012* (2013.01); *A63C 17/015* (2013.01); *A63C 17/0033* (2013.01)

(58) Field of Classification Search
CPC . A63C 17/012; A63C 17/015; A63C 17/0033; A63C 17/0093
See application file for complete search history.

(56) References Cited

U.S. PATENT DOCUMENTS 5,347,681 A * 9/1994 Wattron ..... A63C 17/0033 16/30
6,056,302 A 5/2000 Smith
(Continued)

FOREIGN PATENT DOCUMENTS

DE 102010034908 A1 2/2012
WO 2007127554 A2 11/2007
WO 2012096624 A1 7/2012

OTHER PUBLICATIONS

International Preliminary Report on Patentability dated Sep. 7, 2017 from corresponding PCT Application No. PCT/ES2016/070430.
(Continued)

*Primary Examiner* — Frank B Vanaman
(74) *Attorney, Agent, or Firm* — Innovation Capital Law Group, LLP; Vic Lin

(57) ABSTRACT

A removable assembly for a skateboard comprises a base piece (1) configured for the fixing thereof to a board (40); an upper piece (7) configured for the fixing thereof in a removable manner to a wheel unit (36), the base piece (1) being coupled to the upper piece (7) such that they can rotate with respect to each other; and a torsion spring (6) arranged between the base piece (1) and the upper piece (7) to exert a force aimed at causing them to regain a neutral position.

19 Claims, 13 Drawing Sheets

(56) References Cited

U.S. PATENT DOCUMENTS

| | | | | |
|---|---|---|---|---|
| 6,793,224 | B2 | 9/2004 | Stratton | |
| 2002/0067015 | A1* | 6/2002 | Tierney | A63C 17/0033 280/87.042 |
| 2002/0125670 | A1 | 9/2002 | Stratton | |
| 2005/0160902 | A1* | 7/2005 | Iwai | A63B 25/08 84/723 |
| 2007/0273118 | A1 | 11/2007 | Conrad | |
| 2009/0058028 | A1* | 3/2009 | Chen | A63C 17/0033 280/87.042 |
| 2010/0117317 | A1* | 5/2010 | Smith | A63C 17/0033 280/87.042 |
| 2011/0006497 | A1 | 1/2011 | Chen et al. | |
| 2011/0042913 | A1 | 2/2011 | Landau | |
| 2012/0038121 | A1* | 2/2012 | Chen | A63K 17/0033 280/11.223 |
| 2012/0098222 | A1* | 4/2012 | Chan | B62K 3/002 280/87.041 |

OTHER PUBLICATIONS

International Search Report & Written Opinion dated Aug. 10, 2016 from corresponding PCT Application No. PCT/ES2016/070430.

* cited by examiner

REMOVABLE ASSEMBLY FOR A SKATEBOARD

FIELD OF THE INVENTION

The present invention describes an assembly which can be mounted between the board and the front wheel unit of a traditional skateboard with the purpose of improving the maneuverability thereof in order to convert it into a surfskate.

BACKGROUND OF THE INVENTION

A traditional skateboard fundamentally consists of a board, normally made of wood to which four wheels in pairs are fixed, which serves for practicing the sport called skateboarding. The wheels are grouped in two units of two wheels, the axis of each one being held with a flexible rod slightly inclined in relation to the board which allows it to carry out turns by inclining the board from one side to another and the smooth turning movement of the axes which it entails.

The U.S. Pat. No. 6,056,302 from Marc Smith describes an example of a wheel unit for a traditional skateboard. As can be observed in the figures, the unit is formed by a base fixed to the board and this unit to the axis of the wheels by means of a rod which passes through bushings. This configuration allows for the occurrence of a slight inclination of the wheels in relation to the board when the user is supported on one or the other side of said board which allows smooth turns to be carried out in the direction of displacement.

Recently, a new type of skateboard has emerged called the "surfskate". The difference between a traditional skateboard and a surfskate is fundamentally the type of front wheel unit used. The front wheel unit of a surfskate is configured to allow much greater maneuverability than a traditional skateboard and it is also equipped with a centering spring which exerts an action on the wheels intended to return them to the neutral position thereof. A surfskate has very different behavior to that of a conventional skateboard, allowing the user to propel themselves by simply carrying out oscillatory hip movements similar to those carried out when surfing.

The U.S. Pat. No. 6,793,224 from Carver Skateboard shows an example of a wheel unit for a surfskate. This unit comprises a base couplable to the lower part of a board and an arm coupled to the base which rotates in relation to the same around a first axis. A rod which has a pair of wheels mounted at opposing ends is fixed to said arm and can be rotated in relation to the same around a second axis. A compression spring connected between the base and the arm limits the rotational movement of the arm and returns it towards a central position aligned to the direction of the moving surfskate.

Although the use of this type of wheel unit significantly increases the maneuverability of a surfskate with respect to that of a traditional skateboard, the rotation thereof continues being somewhat insufficient. In addition, it must be separated from the board by means of separators enough in order to avoid the wheel impacting the board. Ultimately, the construction of the unit is complicated and this makes the maintenance and repair operations difficult to carry out.

BRIEF DESCRIPTION OF THE INVENTION

The present invention describes a novel assembly configured for the fixing thereof to a traditional skateboard with the aim of converting it into a surfskate. In effect, the removable assembly of the invention is intended to be mounted between the board and the front wheel unit of a traditional skateboard in order to provide it with a much greater capacity to turn and maneuver without modifying the original distance between axes. In addition, when the distance between the board and the front wheel unit is increased, the problem of the wheels impacting the board when tightly closed turns are carried out is prevented.

The removable assembly for a skateboard of the present invention fundamentally comprises the following elements:

a) a base piece configured for the fixing thereof in a removable manner to a board. As is described further on in this document, the fixing can be carried out by means of screws, bolts or similar.

b) an upper piece configured for the fixing thereof in a removable manner to a wheel unit, the base piece being coupled to the upper piece such that they can rotate with respect to each other. The use of a type of removable fixing both to the board and to the wheel unit allows the assembly of the invention to be installed or uninstalled at any time in order to markedly modify the behavior and maneuverability of the skateboard, causing it to go from being a conventional skateboard to a surfskate and vice versa.

c) a torsion spring arranged between the base piece and the upper piece to exert a force aimed at causing them to regain a neutral position. This torsion spring replaces the compression spring commonly used, which provides the advantages of greater compactness of the assembly and greater protection of the spring from dirt and foreign elements.

This configuration is advantageous in relation to the assemblies normally used in a surfskate for various reasons. With the aim of explaining the advantages in relation to the axis assemblies of the prior art, reference is now made to the document U.S. Pat. No. 6,793,224 from the company, Carver Skateboard which describes an axis assembly for a surfskate referred to in this field. As can be observed, there are principally three advantages which the removable assembly of the present invention presents in relation to the so-called "Carver axis" described in the document U.S. Pat. No. 6,793,224.

Firstly, the assembly of the present invention is removable, in the sense that it can be mounted between the board and the wheel unit of a traditional skateboard in order to easily convert it into a surfskate and subsequently be removed in order to return to a configuration corresponding to a traditional skateboard. To this end, it is sufficient to unscrew the conventional wheel assembly of a traditional skateboard, fix the base piece of the assembly of the present invention in its place and then fix to the upper piece of the present invention the conventional wheel unit which has been previously removed. These operations, which can be carried out in barely a few minutes, radically modify the behavior of the traditional skateboard in order to convert it into a surfskate.

Specifically, in order to allow the fixing of the wheel unit to the removable assembly of the present invention, the upper piece preferably comprises a flat surface intended for the fixing of the wheel unit. As described further below, this flat surface can comprise holes for the fixing of the wheel unit.

In terms of the fixing of the removable assembly of the present invention to the board, the base piece preferably comprises a flat surface intended for the fixing of the board. As will be seen further below in this document, this surface can comprise holes for the fixing of the board.

On the other hand, the axis assembly described in the document U.S. Pat. No. 6,793,224 constitutes a compact unit from which it is impossible to separate the wheel unit. This axis assembly cannot be fixed between the board and the wheel assembly of a conventional skateboard, but rather it is marketed already fixed or intended to be fixed to a board from which it is only separable as a unit including the wheel unit. This assembly can be installed on one or another board, but it will always produce a surfskate, never a traditional skateboard.

Secondly, the assembly of the present invention uses a torsion spring instead of the compression spring used in the Carver axis. In both cases, the function of the spring is to act on the base and upper pieces to cause them to align according to a neutral position corresponding to the rectilinear displacement of the skateboard when no force is exerted on said pieces. However, although the functions of the spring are the same, the use of a torsion spring presents various advantages in relation to a compression spring.

The assembly is more compact with the use of a torsion spring and therefore simpler, more robust, easier to mount and less prone to failures.

In addition, the behavior in the presence of the force of a torsion spring is more progressive than with a compression spring, which causes the movement of the surfskate to be much more continuous and smooth.

In addition, as is described below, the torsion spring can be arranged in a cavity that is fully protected from the exterior in order to prevent the entry of dirt or foreign elements which may affect the behavior thereof.

In fact, although the torsion spring can, in principle, be arranged in different manners in the assembly of the present invention, it is preferably housed in an essentially cylindrical cavity formed between a first flange of the base piece and a second flange of the upper piece which fits into the interior of said first flange. The torsion spring is hidden from view, boxed between both flanges which thus protect it from water, dust or other foreign elements.

The fixing between the spring and the base and upper pieces can also be implemented in different ways, although preferably a first pin of the torsion spring is coupled to a first hole of the base piece and a second pin of the torsion spring is coupled to a second hole of the upper piece. With the aim of avoiding the pins from coming out of said holes, the base piece can comprise an auxiliary hole perpendicular to the first hole for the fixing of the first pin of the torsion spring and the upper piece can comprise an auxiliary hole perpendicular to the second hole for the fixing of the second pin of the torsion spring. These auxiliary holes allow for the insertion of bolts, screws or similar which catch the pins of the torsion spring in order to fix it perfectly between the base piece and the upper piece, avoiding any type of clearance.

In addition, the base piece preferably comprises a stop which cooperates with another stop of the upper piece to limit the rotational angle between the base piece and the upper piece. These stops limit the relative rotation which may be produced between the base piece and the upper piece, impacting when the limit is reached for preventing greater rotational angles. Specifically, according to another preferred embodiment of the invention, the stop of the base piece and the stop of the upper piece are arranged such that they allow a rotation of between 40° and 50° to each side of the neutral position, more preferably an angle of essentially 45°. This rotational angle contrasts with the rotational angle which the smaller Carver axis allows, therefore the maneuverability of the surfskate can be considerably increased.

Thirdly, the assembly of the present invention is much simpler to mount and remove than the Carver axis described in the document U.S. Pat. No. 6,793,224 since the assembly of the present invention preferably uses a single nut for the fixing of all the elements which compose it. Specifically, according to a preferred embodiment of the present invention, the rotary coupling between the base piece and the upper piece comprises a lower axial bearing situated between the base piece and the upper piece, an upper axial bearing situated between the upper piece and a single locking nut of the assembly, and a bolt which passes through the base piece, the lower axial bearing, the torsion spring, the upper piece and the upper axial bearing, the upper piece rotating in relation to the base piece around said bolt.

In this way, in order to access any element of the assembly, it is not necessary to separate it from the board or from the wheel unit to which it is mounted, but rather it is sufficient to remove the locking nut. This allows the base piece to be separated from the upper piece and all the internal pieces of the assembly to be removed.

In addition, according to another preferred embodiment, the bolt is fixed to the base piece by means of screwing. This thus avoids the use of an additional nut such as that used in the Carver axis, facilitating the mounting and removal of the assembly as far as possible.

In addition, the assembly of the present invention has the advantage of allowing the torsion spring housed in the cavity to be changed in a simple manner, which allows the behavior of the surfskate to be modified. In fact, it is sufficient to remove the fixing nut and remove the upper piece to access the cavity where the torsion spring is found which can thereby be changed for another with a different wire diameter. A spring with a smaller wire diameter presents a smoother behavior curve in the presence of the force, while a spring with a greater wire diameter presents a more aggressive curve. Therefore, providing a set of springs with different wire diameters provides the user with the possibility of modifying the behavior of the surfskate as they desire. It is envisaged that the spring has, amongst others, a circular, curved or polygonal transversal section such as square, rectangular, hexagonal or similar.

On the other hand, the Carver axis allows the force that the compression spring thereof generates to be regulated by means of an adjusting screw. However, the range of said regulation is not very high and therefore does not allow the behavior of the surfskate to be modified to a great extent.

Consequently, the present invention is also directed at an assembly of parts formed by: a removable assembly like the one previously described; and a set of torsion springs with different wire diameters.

DETAILED DESCRIPTION OF THE INVENTION

Figure 1:
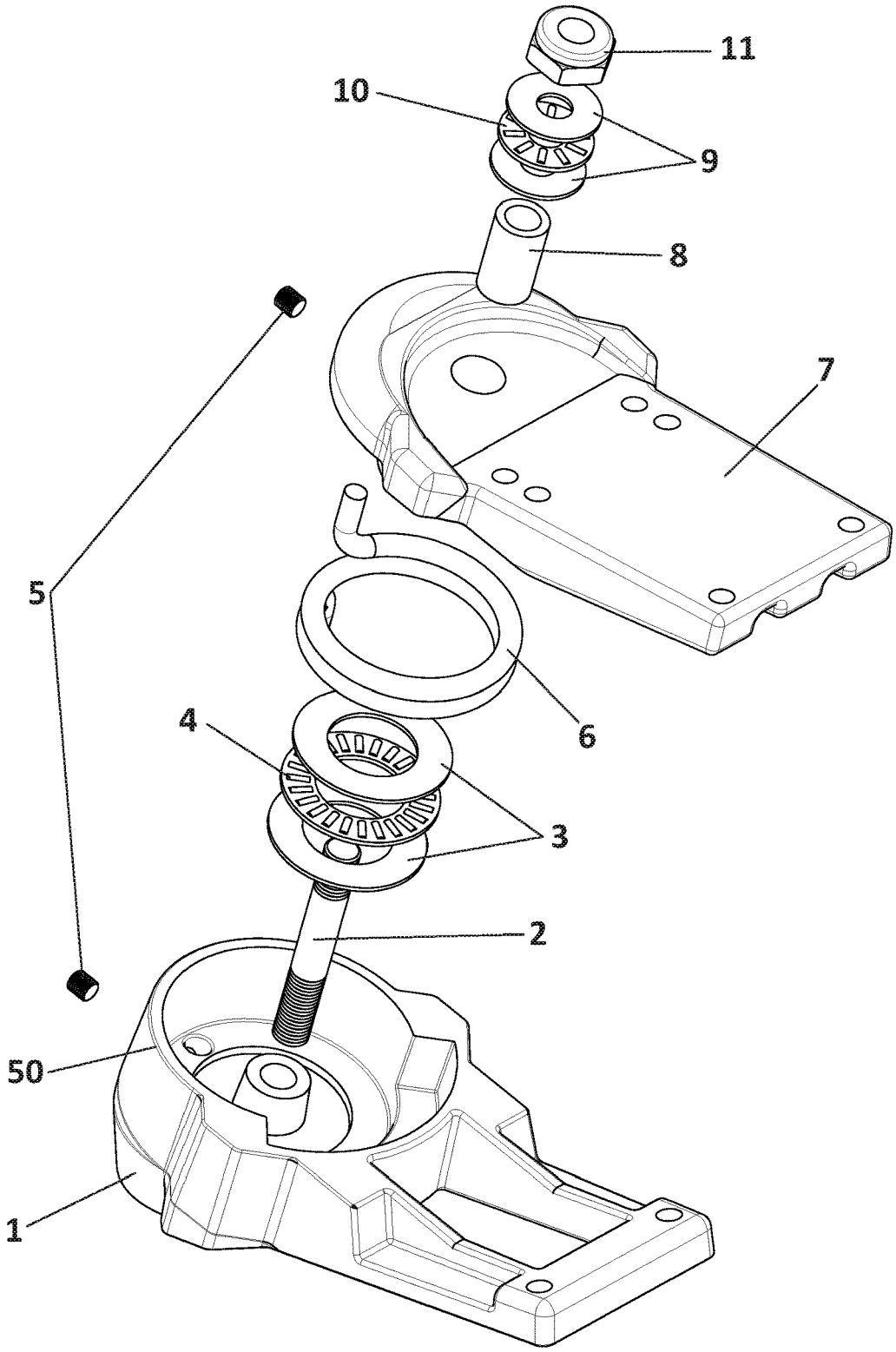
FIG. 1 shows an exploded perspective view of an exemplary assembly according to the invention.

FIG. 1 shows an exploded view of an exemplary removable assembly according to the present invention. The base piece (1), which in this example is obtained by aluminum gravity casting with post heat treatment, is fixed by means of threading to the lower end of a steel bolt (2) with threading at each one of the ends thereof. This bolt (2) forms the rotational axis around which the upper piece rotates (7) owing to an axial needle bearing system arranged around said bolt (2). Specifically, the bearing system is formed by two washers (3) and an axial needle bearing (4) and is arranged between the base piece (1) and the upper piece (7) to allow the rotation of the second piece with respect to the first.

The torsion spring (6) is provided around the axial needle bearing system. As can be observed in greater detail in subsequent figures, the torsion spring (6) is located at the bottom of an essentially cylindrical cavity formed by a first cylindrical flange (50) of the base piece (1) and is fixed to the same owing to a first hole (14) which receives a pin of the torsion spring (6). An auxiliary hole (13) perpendicular to the first hole (14) allows for the insertion from the exterior of the assembly of a threaded fixing bolt (5) which prevents the exit of the pin from the torsion spring (6). The cavity is completed with the insertion of a second cylindrical flange (51) of the upper piece (7) in the interior of the first flange (50) of the base piece (1) until it is supported on the bottom. A space or cavity is produced in an essentially closed cylindrical manner between both flanges (50, 51) which protects the torsion spring (6) from the entry of dirt and foreign elements. What is more, this cavity formed by the first flange (50) of the base piece (1) in combination with the second flange (51) of the upper piece (7) not only houses the torsion spring (6), but also the first axial bearing system which is thus also protected. The torsion spring (6) is fixed to the upper piece (7) by means of inserting another pin into a second hole (28). An auxiliary hole (27) perpendicular to the second hole (28) allows for the insertion of a bolt for the fixing of the pin of the torsion spring (6).

The upper piece (7), also obtained by aluminum gravity casting with post heat treatment rotates around a bronze bearing (8) to which it is joined under pressure and the function of which is to limit the friction during the rotation. For mounting, the bearing (8) is introduced through the upper end of the bolt (2) until it is supported on the washer (3). Then, once the upper piece (7) is installed and the torsion spring (6) fixed by means of the threaded bolts (5), a second axial needle bearing system formed by another two washers (9) and an axial needle bearing (10) is installed and they are introduced through the upper end of the bolt (2) and are fixed by means of a single self-locking nut (11).

Figure 2A:
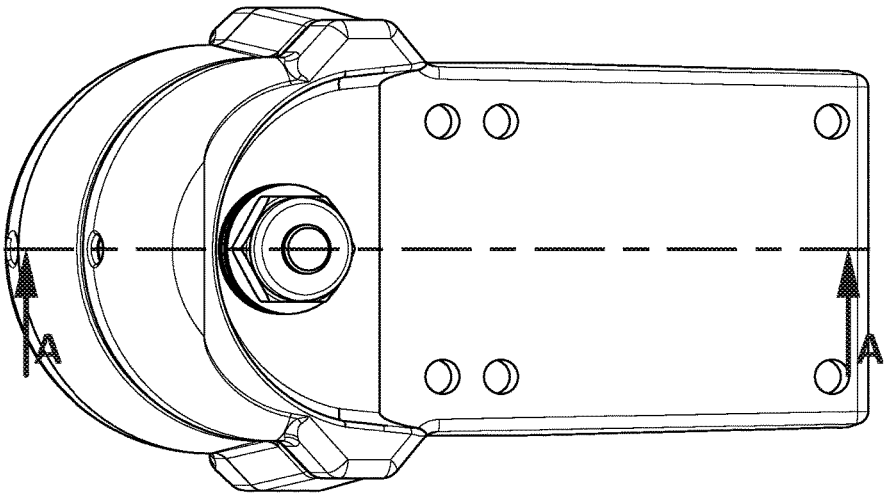
FIGS. 2A and 2B respectively show an upper view of the assembly and a section along the plane of symmetry A-A thereof.
Figure 2B:
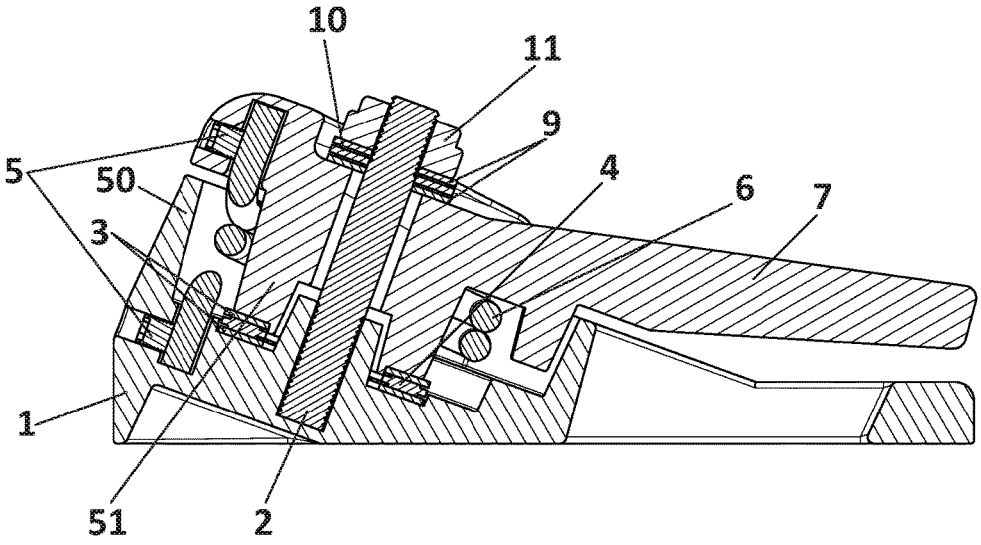

The position of all these elements when the assembly is completely mounted is observed in the section of FIG. 2A along the plane of symmetry of the complete mounted assembly shown in FIG. 2B.

Figure 3A:
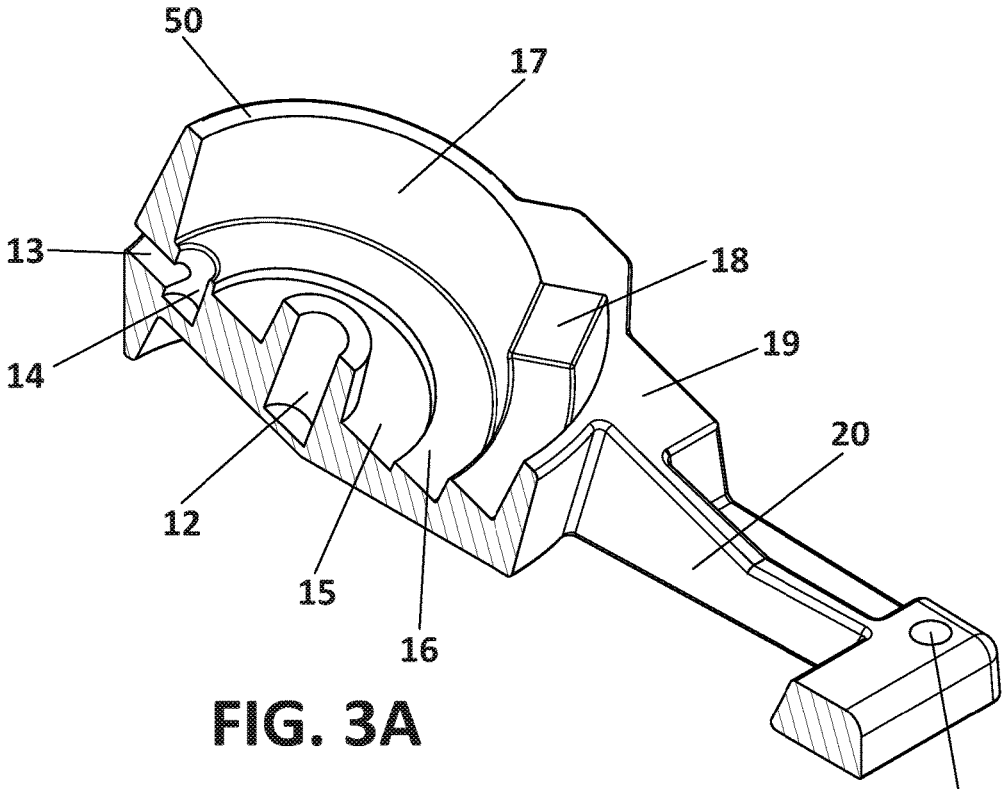
FIGS. 3A and 3B show two sections along the plane of symmetry of the base piece viewed respectively from above and from below.
Figure 3B:
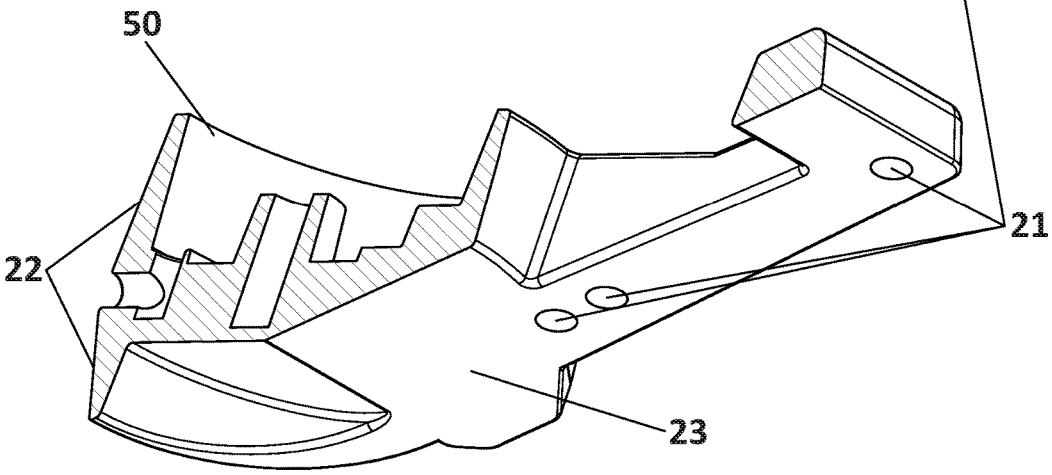

FIGS. 3A and 3B show two views of a section along the plane of symmetry of the base piece (1). The base piece (1) has a flat surface called base (23) intended to be supported on a board (40) of the skateboard for the fixing thereof to the same. To this end, countersunk screws are introduced by way of the threaded bores (21) of the base (23) and holes (37) corresponding to the front part or nose (38) of the skateboard. The base piece (1) also has a threaded hole (12) located in the center of the essentially cylindrical first flange (50) which receives the torsion spring (6) which serves for the fixing of the lower end of the bolt (2). The washer (3) of the first axial bearing system is supported on a horizontal circular surface (15) on the bottom of the cavity formed by the first flange (50), while the torsion spring (6) is located on a horizontal circular surface (16) with a greater radius than the previous surface. This horizontal circular surface (16) has a first vertical hole (14) intended to receive a pin of the torsion spring (6). A hole (13) perpendicular to said first vertical hole (14) allows for the introduction of a bolt (5) for fixing the pin.

The base piece (1) also comprises a stop (18) which projects from the first flange (50) with the aim of limiting the amplitude of the rotation of the upper piece (7) in relation to the base piece (1), as is described in greater detail in relation to FIGS. 7 and 8. The surface (22) is the front part of the base piece (1) according to the direction of the movement of the skateboard and protects the interior of the cavity from impacts and dirt. The surface (19) is perpendicular to the rotational axis of the bolt (2). The area (20) is an empty area for reducing weight.

Figure 4A:
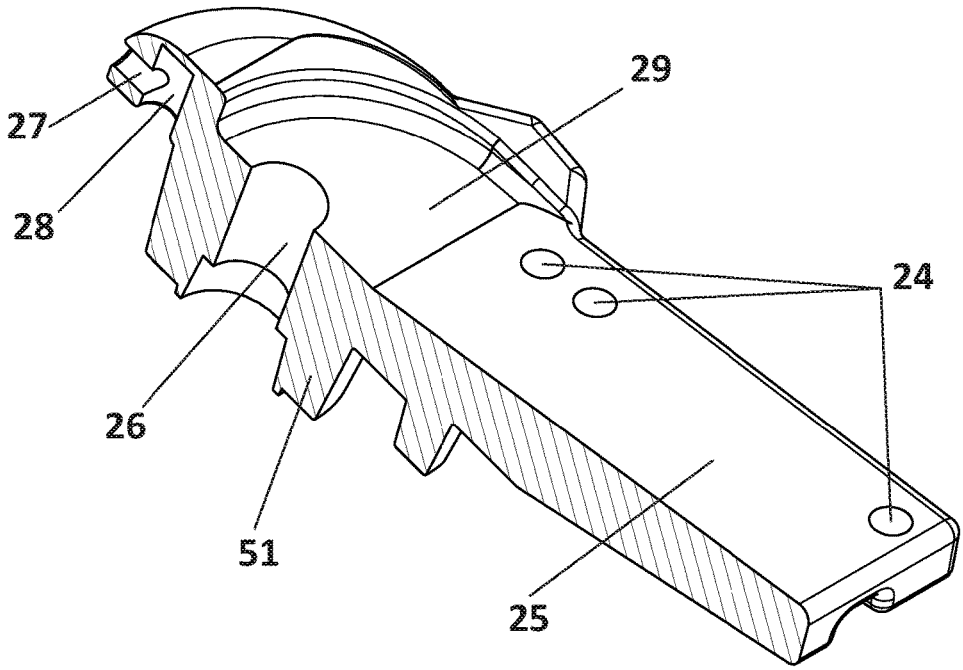
FIGS. 4A and 4B show two sections along the plane of symmetry of the upper piece viewed respectively from above and from below.
Figure 4B:
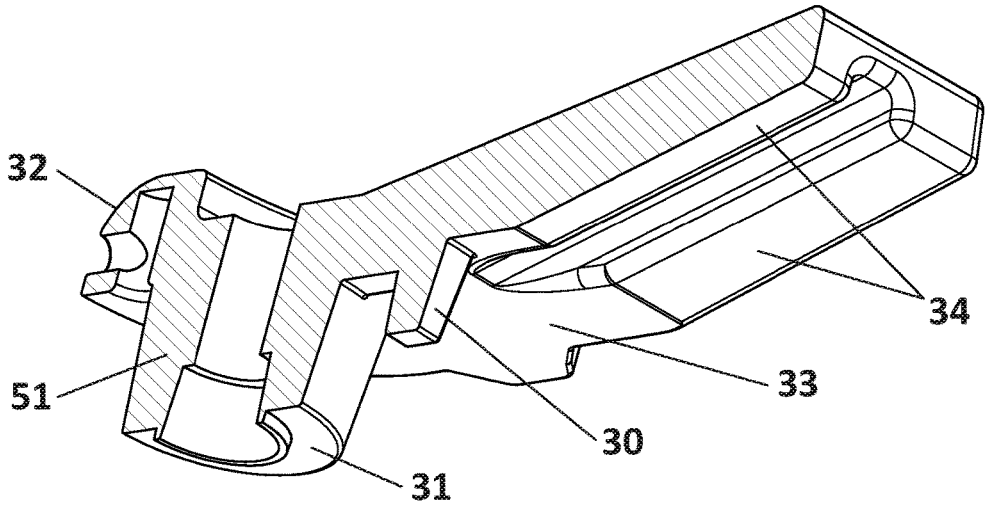

Similarly, FIG. 4 shows two views of a section along the plane of symmetry of the upper piece (7). A flat surface can be observed which forms the base (25) intended to be supported on an equally flat surface of the traditional wheel unit (36) for the fixing thereof to the same. To this end, screws are introduced through the threaded holes (24) arranged on the base (25) and in corresponding holes of the wheel unit (36). The upper piece (7) also has a reamed bore (26) intended to receive the bearing (9) under pressure. The laterals of said bore (26) form the second essentially cylindrical flange (51) which, as previously mentioned, is introduced into the first flange (50) of the base piece (1) to protect the spring (6) and the first axial bearing system. The surface (31) of the upper end of the second flange (51) forms the support on which the washer (3) of the first axial bearing system is located. The axial spring (6) is supported on a circular surface external to said second flange (51) in which the second hole (28) is located which receives the pin of the spring. An auxiliary threaded bore (27) perpendicular to the second hole (28) allows a bolt (5) for fixing the pin of the torsion spring (6) to be introduced from the exterior of the assembly.

The surface (29) is a continuation of the base surface (25), although it forms a small angle with the same. The surface (33) is located on the side opposing the upper piece (7) and is the surface from which the second flange (51) projects and where the second hole (28) is located. The surfaces (29, 33) are parallel to each other and perpendicular to the rotational axis of the bolt (2). The washer (9) of the second axial bearing system is supported on the surface (29). The surface (32) is the front part of the upper piece (7) and protects the assembly against possible impacts, in addition to providing it with rigidity. The ribs (34) also provide the assembly with rigidity. The upper piece (7) also has a stop (30) which projects from the surface (33) at a certain distance from the second flange (51), in a position corresponding to that of the stop (18) of the base piece (1). The stop (30) of the upper piece (7) cooperates with the stop (18) of the base piece (1) to limit the rotational angle of the first piece in relation to the second piece.

In order to fix different torsion springs (6), which have different resistances and section diameters, alternatively to the arrangement of threaded fixing bolts (5), an embodiment is envisaged, as has been depicted in FIGS. 13 to 17 which comprises a fixing washer (65', 65") for each pin of the torsion spring such that an upper fixing washer (65') is internally fixed to the upper piece (7) at the area of the housing cavity of the torsion spring (6), while a lower fixing washer (65") is internally fixed to the base piece (1) at the area of the housing cavity of the spring (6). This fixing is carried out by means of two fixing screws (67), which pass through two fixing holes (68) situated on the fixing washers (65', 65"). As can be observed in the exploded view of FIG. 15, it is envisaged that one toothed washer (69) is provided for each fixing screw (67) in order to ensure that there is no movement between each fixing screw (67) and the corresponding piece (1, 7).

Each fixing washer (65', 65") comprises at least two insertion holes (66), although there may be more, preferably three, of different diameters, such that they can be passed through, minimizing the clearance through the torsion spring pins (6) of different diameters.

The possibility is envisaged of the angular arrangement of the insertion holes (66) varying between the upper fixing washer (65') and the lower fixing washer (65") for the purpose of being able to resolve possible misalignments of the pins of the torsion spring (6).

This alternative is more efficient when maintaining said fixing in spite of the vibrations to which it is subjected during the time of use thereof.

Figure 15:
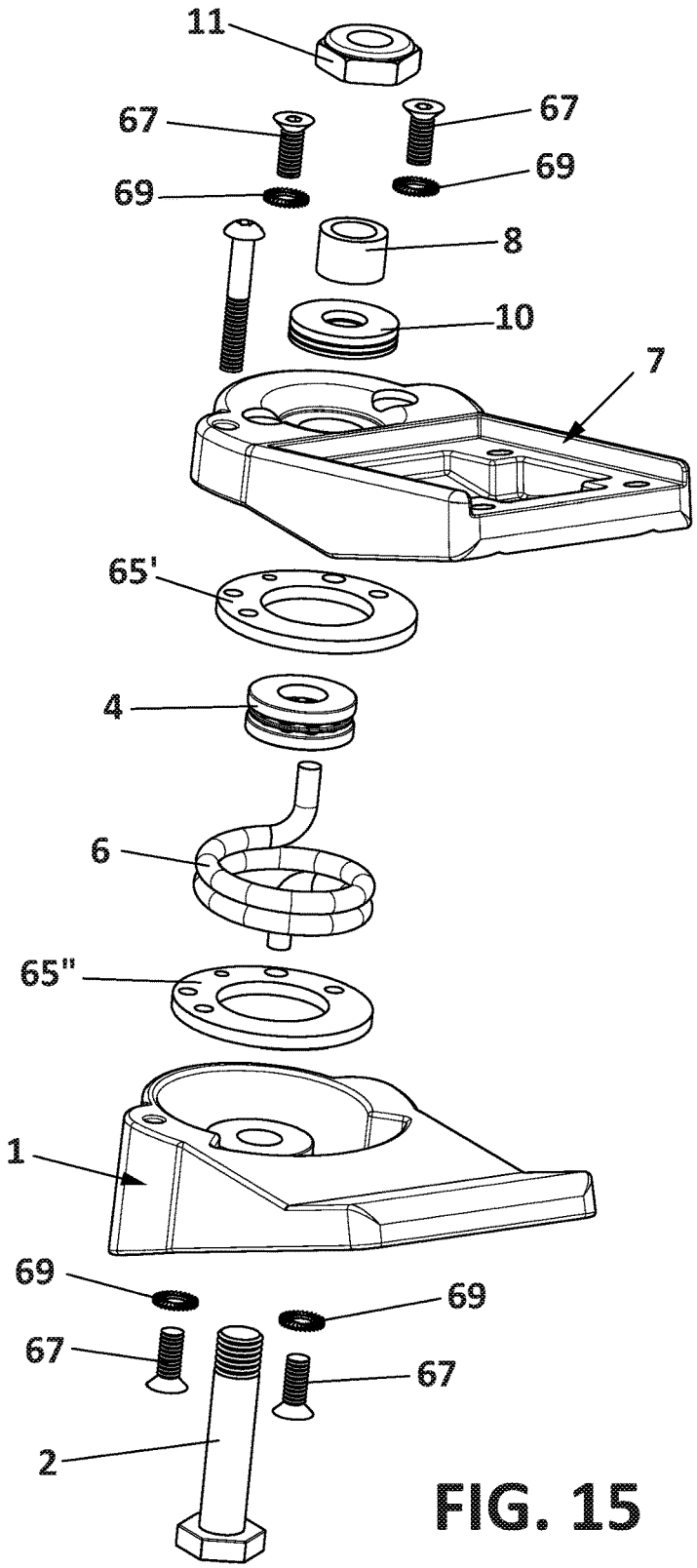
FIG. 15 shows an exploded view of the entire assembly according to the embodiment depicted in FIGS. 13 and 14.
Figure 16:
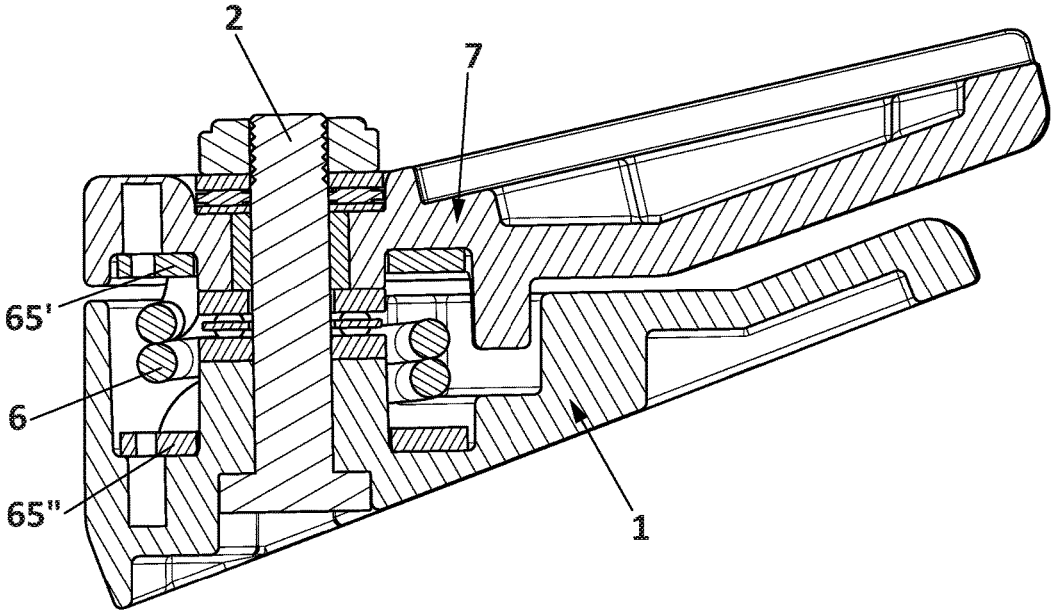
FIGS. 16 and 17 respectively show a longitudinal and transversal section of the embodiment depicted in FIG. 15.
Figure 17:
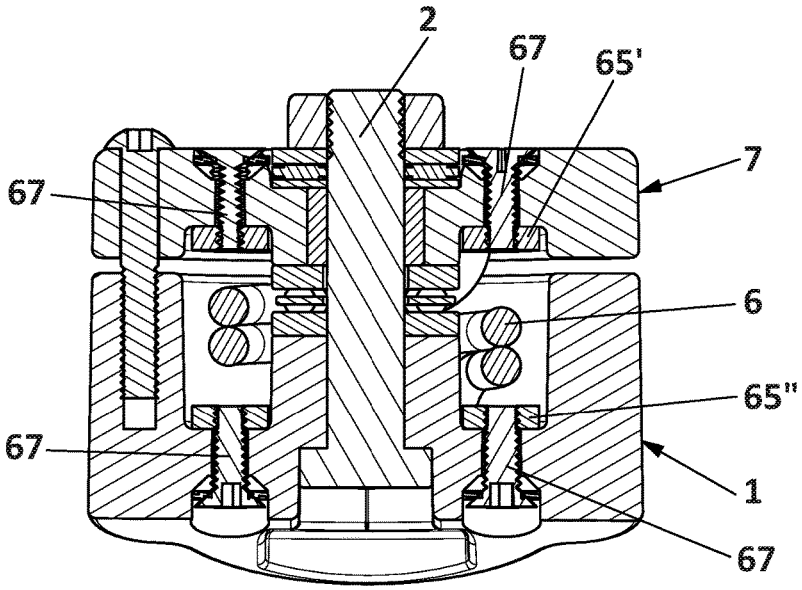

By means of this embodiment, unlike the previous ones in which the spring (6) is directly fixed to the upper pieces (7) and base (1), because the spring (6) is made of steel, it avoids the pieces (1, 7), which are usually made of aluminum, deteriorating, therefore the fixing washers (65', 65") are preferably made of steel and since they are each bound at two points by means of the fixing screws (67) to the upper pieces (7) and base (1), this problem is avoided. This is also why the aluminum pieces (1, 7) are not threaded in the area through which the fixing screw (67) passes, but rather it is opted to fix it, preferably with toothed washers (69) as are shown in FIG. 15 since the thread with the stresses would end up wearing the aluminum and losing the function thereof.

Figure 5A:
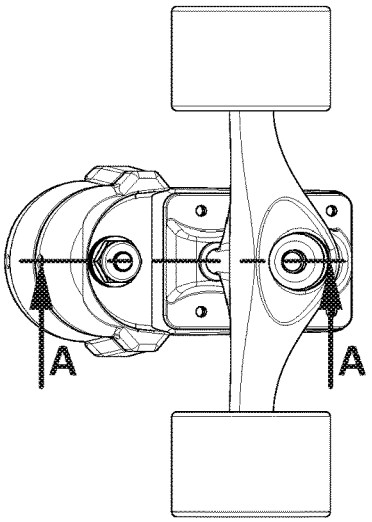
FIGS. 5A, 5B and 5C respectively show a lower view of an assembly according to the invention fixed to a traditional wheel unit, a section along the plane of symmetry A-A thereof and a perspective view of said assembly and of the traditional wheel unit.
Figure 5B:
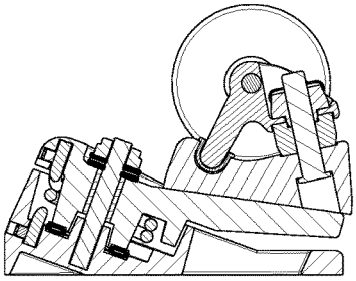
Figure 5C:
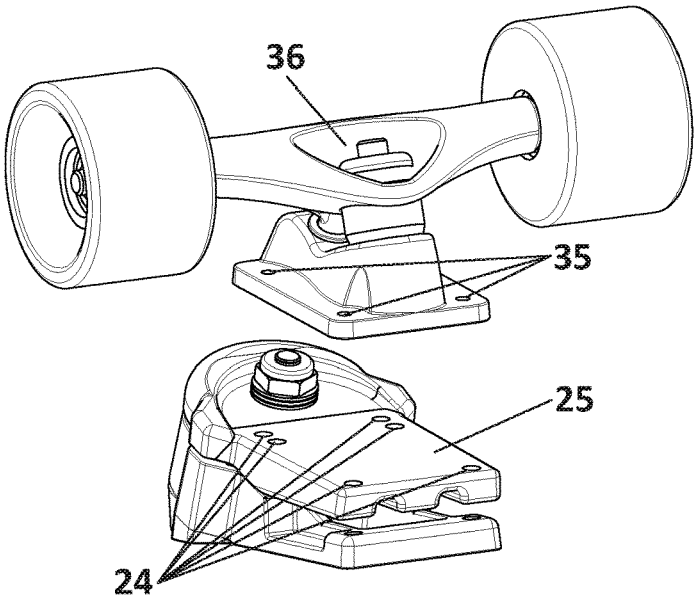

FIG. 5A shows the assembly fixed to a conventional wheel unit (36) of a skateboard. FIG. 5B shows a detail of the section along the plane A-A of FIG. 5A, and FIG. 5C shows a perspective of both elements still not joined. As was previously described, the wheel unit (36) is joined to the base surface (25) of the upper piece (7) by means of screws which are introduced into the threaded bores (24) and into the bores (35) with which the wheel unit (36) is provided.

Figure 6A:
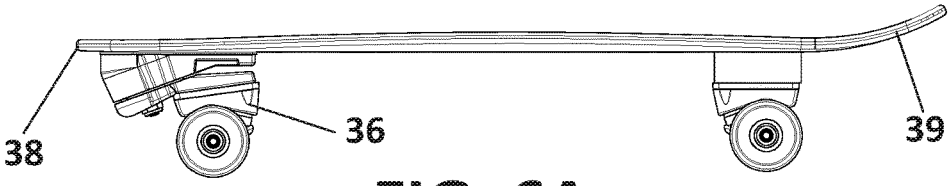
FIGS. 6A, 6B and 6C respectively show side, bottom and perspective views of the assembly of the invention fixed to a traditional wheel unit and a board.
Figure 6B:
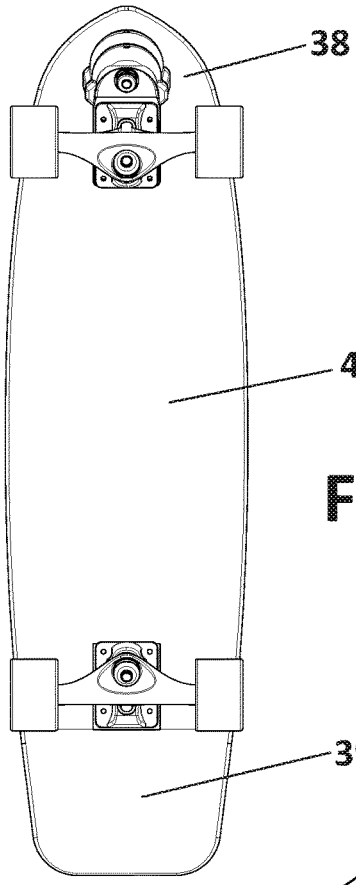
Figure 6C:
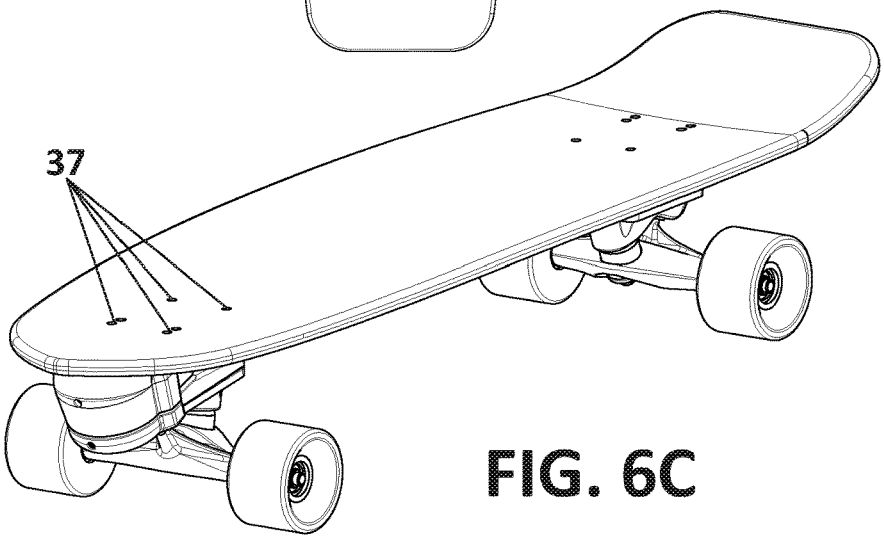

FIG. 6 shows three views of a skateboard already with the assembly mounted between the conventional wheel assembly (36) of the nose (38) of the skateboard and the board (40). The rear wheel unit (36) located at the tail (39) does not require the installation of the assembly of the invention, therefore it is recommended to elevate it by means of shims so that the nose (38) of the skateboard is not elevated too much. The rear wheel unit (36) performs a similar function to that of the keel of a surfboard during the transformation of the skateboard to a surfskate. In these figures, it is also observed how the original distance between axes of the skateboard is maintained.

Figure 7A:
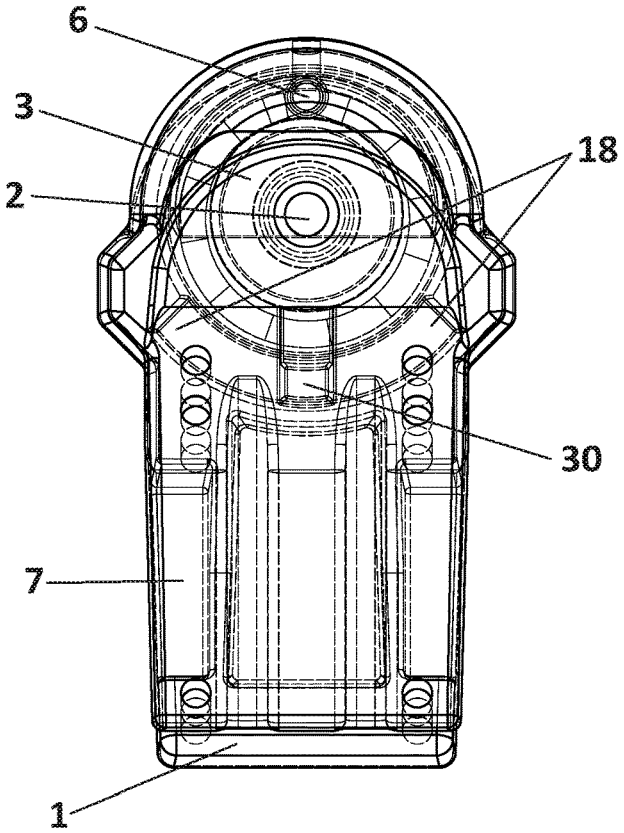
FIGS. 7A and 7B respectively show a view of the assembly of the invention with the torsion axis in a neutral position and a complete view of the assembly of the invention fixed to a traditional wheel unit and to a board where the torsion axis is in a neutral position.
Figure 7B:
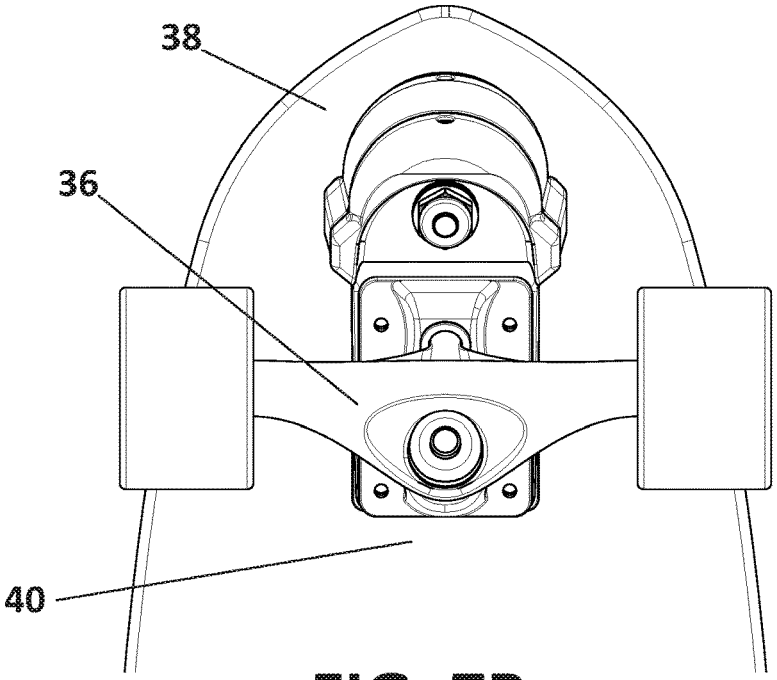

FIG. 7A shows a detail of the assembly with a torsion spring (6) in a neutral position corresponding to a rectilinear displacement of the skateboard. FIG. 7B shows the assembly in the same position already fixed to the board (40) and to the wheel unit (36). In this neutral position, no type of force is exerted on the longitudinal laterals of the board (40) and both the stop and the pins of the torsion spring (6) are maintained in the plane of symmetry aligned with the bolt (2) which is the rotational axis.

Figure 8A:
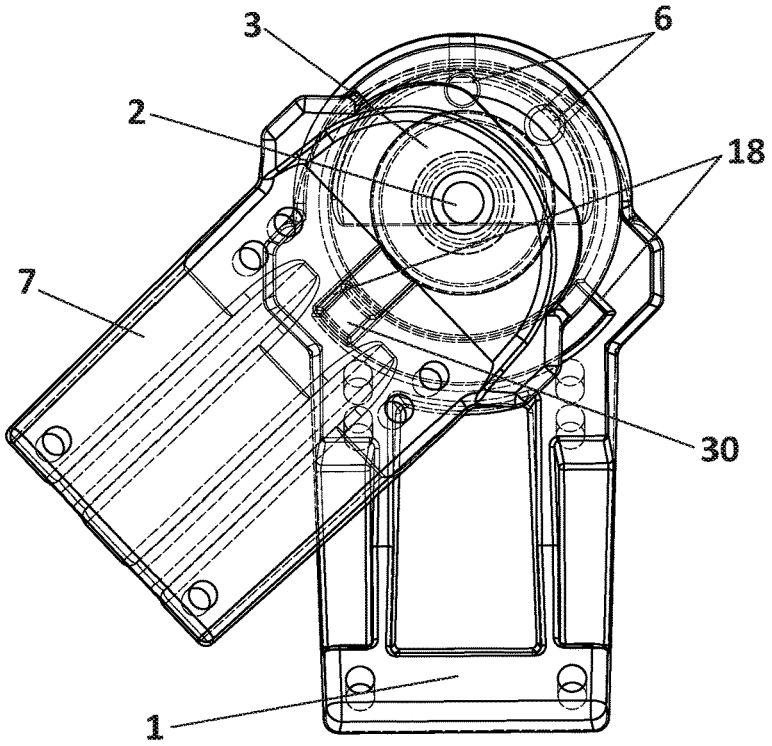
FIGS. 8A and 8B respectively show a view of the assembly of the invention with the torsion axis in the more open position and a complete view of the assembly of the invention fixed to a traditional wheel unit and to a board where the torsion axis is in the more open position.
Figure 8B:
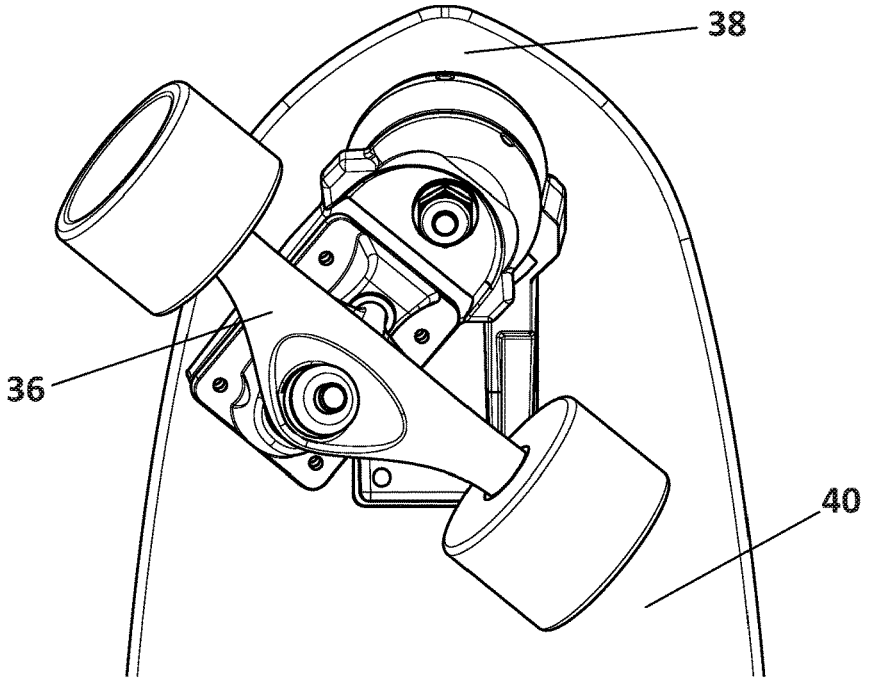

FIG. 8A shows a detail of the assembly of the torsion spring (6) in one of the more open positions in a clockwise direction. FIG. 8B shows the assembly in the same position already fixed to the board (40) and to the wheel unit (36). In this open position of the spring, with a maximum rotation of 45°, it now exerts a force F on the longitudinal lateral of the board (40). This causes the upper piece (7) to rotate with respect to the bolt (2) until the stop (30) impacts the stop (18) of the base piece (1). During this entire movement, the pins of the torsion spring (6) remain fixed respectively to the base piece (1) and to the upper piece (7).

Figure 9:
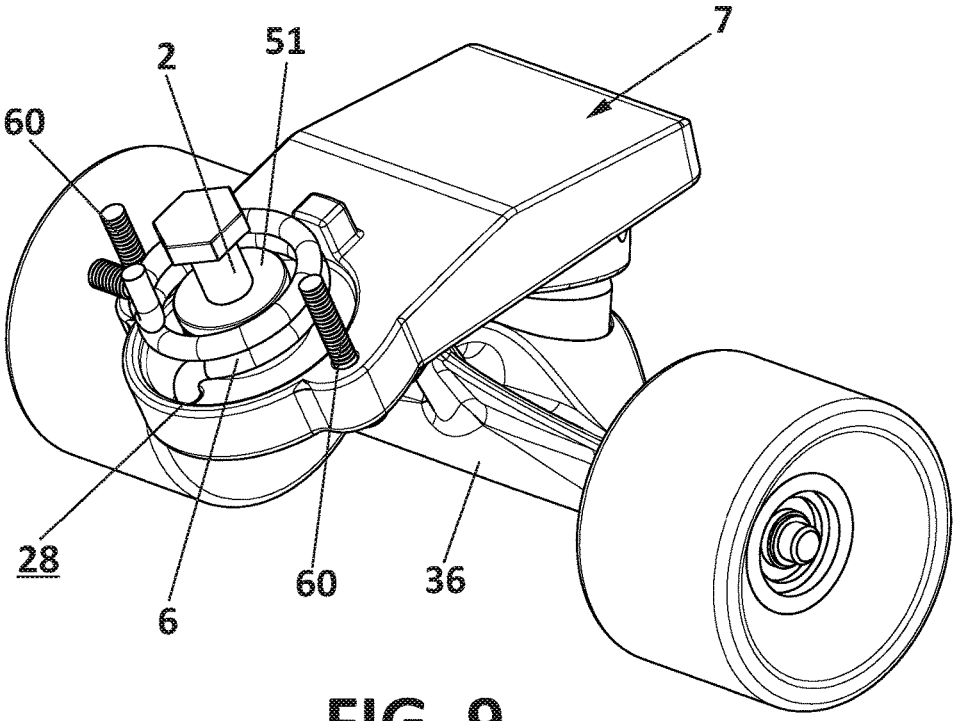
FIG. 9 shows a perspective view of the upper piece mounted in a wheel unit in which locking means can be observed which allow the rotation between the upper piece and the base piece to be prevented.

FIG. 9 shows a perspective view of the upper piece (7) mounted on a wheel unit (36) in which according to an embodiment variant, locking means (60) can be observed, which consist of two screws which allow the rotation between the upper piece (7) and the base piece (1) to be prevented, which can be implemented by the user in the case that they wish to avoid the rotation between both pieces (1, 7).

Figure 10:
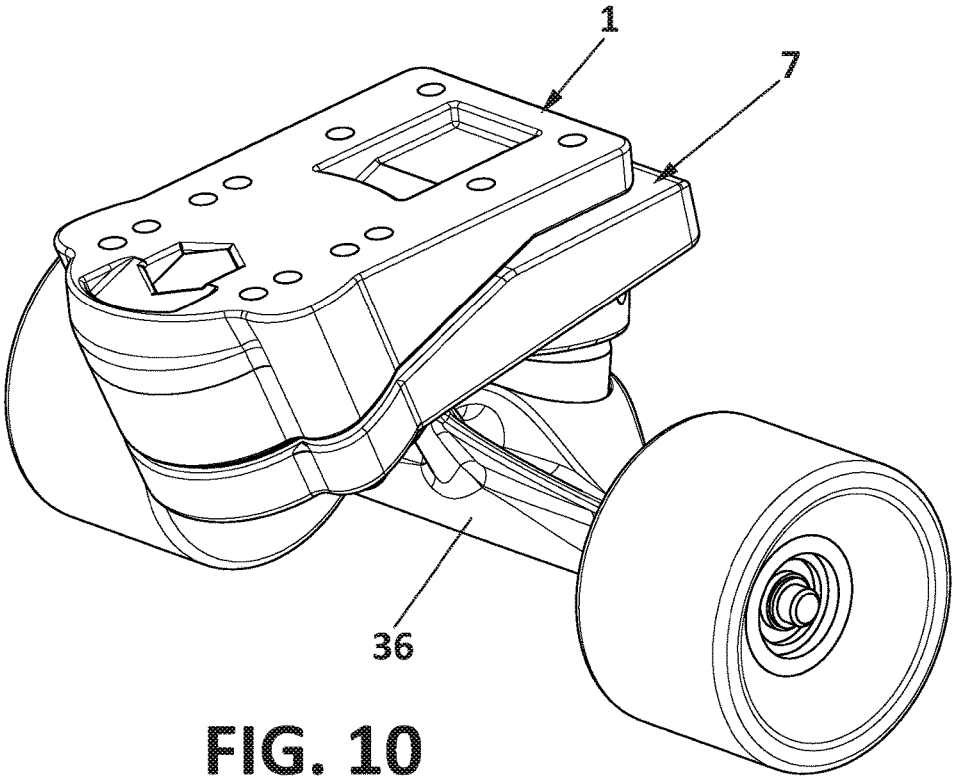
FIG. 10 shows a perspective view like the one of FIG. 9 with the base piece coupled and fixed to the upper piece with the rotation locked with respect to the latter by means of locking means.

FIG. 10 shows a perspective view like the one of FIG. 9 with the base piece (1) coupled and fixed to the upper piece (7) with the rotation locked with respect to the latter by means of locking means (60).

Figure 11:
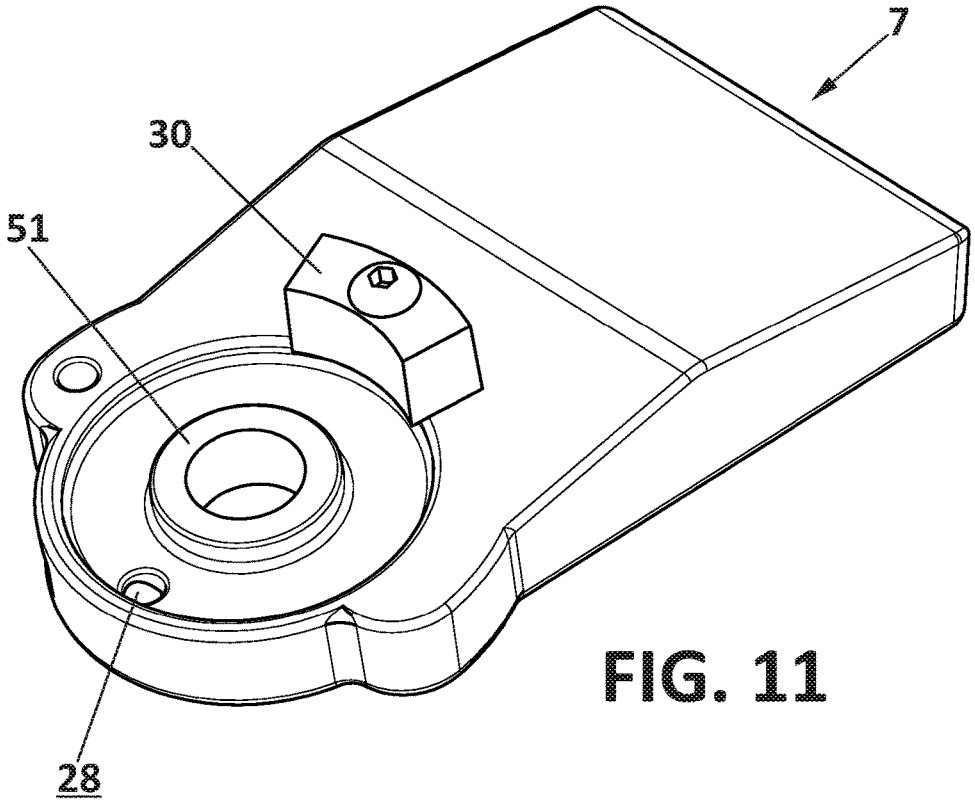
FIG. 11 shows a perspective view of a variant of the upper piece which incorporates a hole for the arrangement of locking means like those depicted in FIG. 9 and which comprises a stop configured for receiving fixing means for the arrangement of a rotation-limiting element.

FIG. 11 shows a perspective view of a variant of the upper piece (7) which incorporates a single hole for the arrangement of locking means (60) which in this case consists of a single screw in a similar manner to that depicted in FIG. 9.

Figure 12:
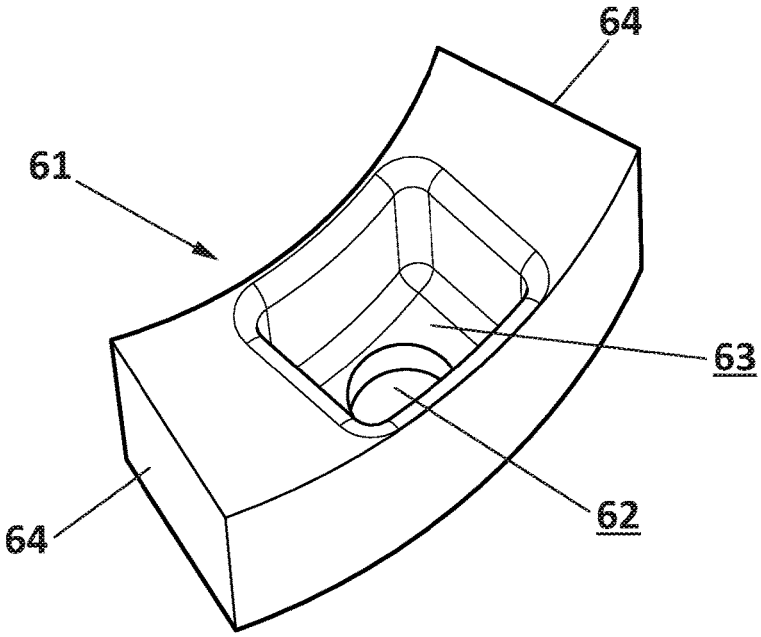
FIG. 12 shows a perspective view of an element limiting rotation to 30°, provided for being fixed on the stop of the upper piece depicted in FIG. 11.
Figure 13:
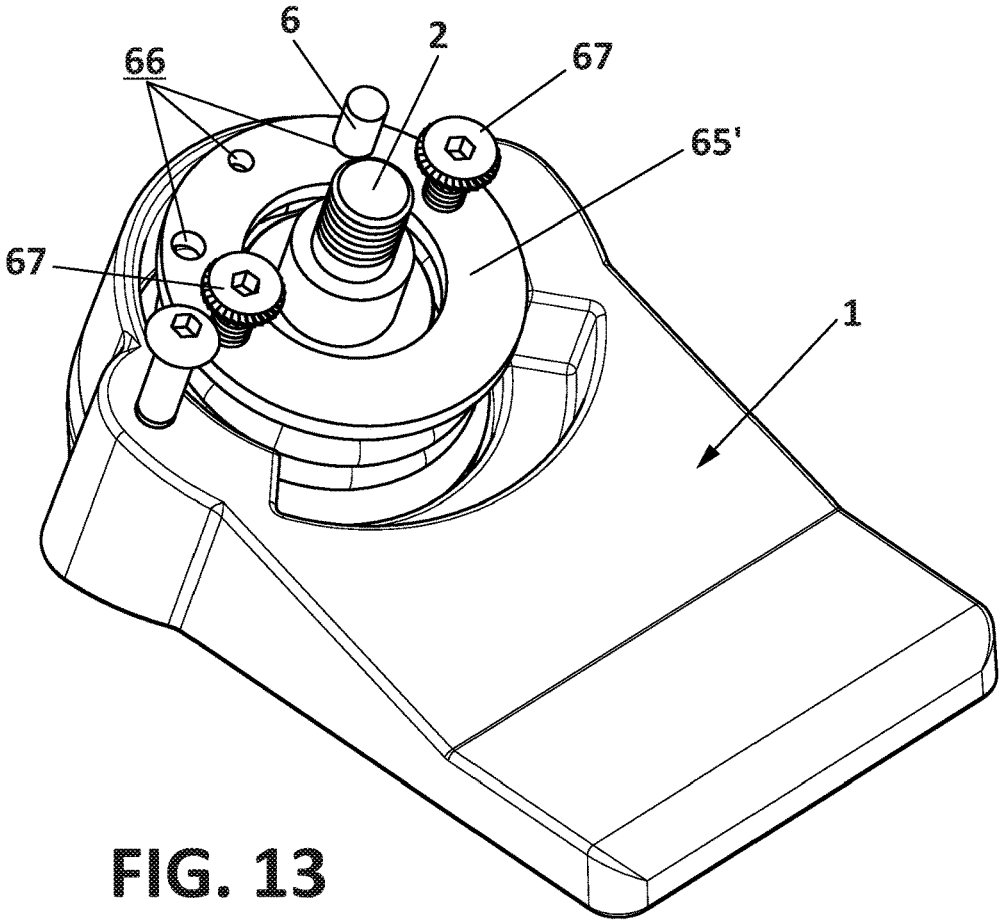
FIG. 13 shows a perspective view in which an alternative for the fixing of the torsion spring has been depicted, the base piece, the torsion spring and an upper fixing washer with the respective fixing screws thereof having been depicted, but without the upper piece having been depicted.
Figure 14:
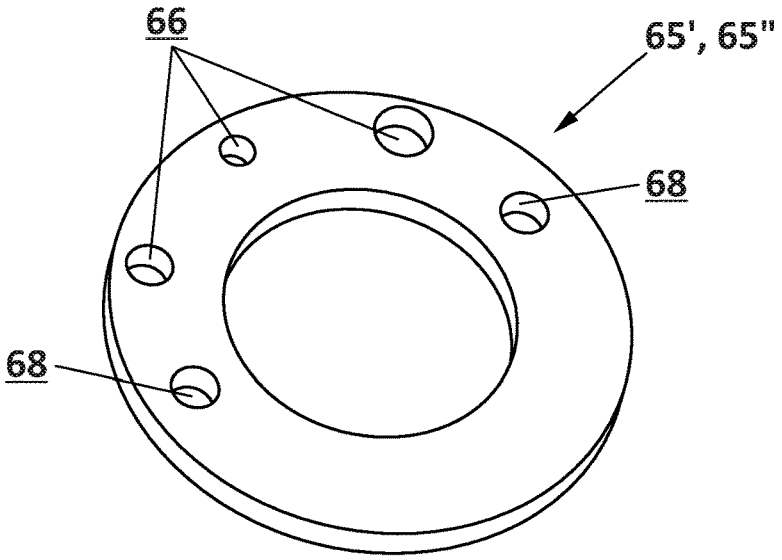
FIG. 14 shows a perspective view of an embodiment of the fixing washer.

In addition, the upper piece (7) depicted in FIG. 11 also comprises a stop (30) which is configured for receiving fixing means for the arrangement of a rotation-limiting element (61). Said fixing means can consist of a screw passing through a fixing hole (62) of the rotation-limiting element (61) which has been depicted in FIG. 12, where a perspective view of the rotation-limiting element (61) is shown, the lateral walls of which (64) define the complete rotational angle permitted, in the case depicted it is 30°. The rotation-limiting element (61) comprises a coupling recess (63) which is coupled to the stop (30) of the upper piece (7), being fixed to the latter by means of the screw passing through the fixing hole (62), thus reducing the rotation permitted between the upper piece (7) and the base piece (1) which can be selected by the user.

When the force F ceases to be exerted on the longitudinal lateral of the board (40), the torsion spring returns the accumulated energy and returns the assembly to the neutral position thereof corresponding to the rectilinear displacement. By alternating the application of force on the laterals of the board, simulating the way in which the body moves on a surfboard in order to cause it to turn towards both sides, a movement towards the front of the surfskate is produced.

The invention claimed is:

1. A removable assembly for converting a skateboard formed by a board, a front wheel unit and a rear wheel unit, into a surfskate, the removable assembly comprising:

a base piece (1) configured for the fixing thereof to the board (40) of the skateboard;

an upper piece (7) configured for the fixing thereof in a removable manner to the front wheel unit (36), and a torsion spring (6) arranged between the base piece (1) and the upper piece (7); where the base piece (1) is coupled to the upper piece (7) such that they can rotate with respect to each other; and where the torsion spring (6) exerts a force aimed at causing both pieces (1,7) to regain a neutral position corresponding to a rectilinear displacement of the skateboard and where when the removable assembly is attached to the board and the front wheel unit attached to the upper piece (7), a first distance between the board (40) and the front wheel unit is increased as compared to when the front wheel unit is attached directly to the board (40), wherein a second distance between the front wheel unit and the rear wheel unit of the skateboard is unchanged when the removable assembly is disposed between the board and the front wheel unit.

2. The assembly according to claim 1, wherein the torsion spring (6) is housed in an essentially cylindrical cavity formed between a first flange (50) of the base piece (1) and a second flange (51) of the upper piece (7) which fits into the interior of said first flange such that the torsion spring (6) is fully protected from the exterior in order to prevent the entry of dirt or foreign elements which may affect the behavior thereof.

3. An assembly according to claim 2 which comprises at least one fixing washer (65', 65") which is internally fixed to one of the pieces (1, 7) through an area of the housing cavity of the torsion spring (6) by means of two fixing screws (67) which pass through two fixing holes (68) situated in said at least one fixing washer (65', 65") which also comprises at least two insertion holes (66) of different diameters which can receive a pin of the torsion spring (6).

4. The assembly according to claim 1, wherein a first pin of the torsion spring (6) is coupled to a first hole (14) of the base piece (1) and a second pin of the torsion spring (6) is coupled to a second hole (28) of the upper piece (7).

5. The assembly according to claim 4, wherein the base piece (1) comprises an auxiliary hole (13) perpendicular to the first hole (14) for the fixing of the first pin of the torsion spring (6) and the upper piece (7) comprises an auxiliary hole (27) perpendicular to the second hole (28) for the fixing of the second pin of the torsion spring (6).

6. The assembly according to claim 1, wherein the base piece (1) comprises a stop (18) which cooperates with another stop (30) of the upper piece (7) to limit the rotational angle between the base piece (1) and the upper piece (7).

7. The assembly according to claim 6, wherein the stop (18) of the base piece (1) and the stop (30) of the upper piece (7) are arranged such that they allow a rotation of between 40° and 50° to each side of the neutral position.

8. The assembly according to claim 1, wherein the rotary coupling between the base piece (1) and the upper piece (7) comprises a lower axial bearing (4) situated between the base piece (1) and the upper piece (7), an upper axial bearing (10) situated between the upper piece (7) and a single locking nut (11) of the assembly, and a bolt (2) which passes through the base piece (1), the lower axial bearing (4), the torsion spring (6), the upper piece (7) and the upper axial bearing (10), the upper piece (7) rotating in relation to the base piece (1) around said bolt (2).

9. The assembly according to claim 8, wherein the bolt (2) is fixed to the base piece (1) by means of screwing.

10. The assembly according to claim 1, wherein the upper piece (7) comprises a flat surface (25) intended for the fixing of the wheel unit (36).

11. The assembly according to claim 10, wherein the flat surface (25) comprises holes (24) for the fixing of the wheel unit (36).

12. The assembly according to claim 1, wherein the base piece (1) comprises a flat surface (23) intended for the fixing of the board (40).

13. The assembly according to claim 12, wherein the flat surface (23) comprises holes (21) for the fixing of the board (40).

14. The assembly according to claim 1, comprising a rotation-limiting element (61) which comprises a coupling recess (63) which can be coupled to a stop (30) of the upper piece (7) and fixed to the latter such that it reduces the permitted rotation between the upper piece (7) and the base piece (1).

15. The assembly according to claim 1, which comprises locking means (60) which prevent the rotation between the upper piece (7) and the base piece (1).

16. A removable assembly for converting a skateboard formed by a board, a front wheel unit and a rear wheel unit, into a surfskate, the removable assembly comprising:

a base piece (1) configured for the fixing thereof to the board (40) of the skateboard;

an upper piece (7) configured for the fixing thereof in a removable manner to the front wheel unit (36), and a torsion spring (6) arranged between the base piece (1) and the upper piece (7); where the base piece (1) is coupled to the upper piece (7) such that they can rotate with respect to each other; and where the torsion spring (6) exerts a force aimed at causing both pieces (1,7) to regain a neutral position corresponding to a rectilinear displacement of the skateboard and where when the removable assembly is attached to the board and the front wheel unit attached to the upper piece (7), the distance between the board (40) and the front wheel unit is increased as compared to when the front wheel unit is attached directly to the board (40), wherein the upper piece (7) includes a flat surface (25) having the front wheel unit of the skateboard affixed there to when the removable assembly is used on the board (40);

a first pin of the torsion spring (6) is coupled to a first hole (14) of the base piece (1) and a second pin of the torsion spring (6) is coupled to a second hole (28) of the upper piece (7); and the base piece (1) comprises an auxiliary hole (13) perpendicular to the first hole (14) for the fixing of the first pin of the torsion spring (6) and the upper piece (7) comprises an auxiliary hole (27) perpendicular to the second hole (28) for the fixing of the second pin of the torsion spring (6).

17. The assembly according to claim 16, wherein the torsion spring (6) is housed in an essentially cylindrical cavity formed between a first flange (50) of the base piece (1) and a second flange (51) of the upper piece (7) which fits into the interior of said first flange such that the torsion spring (6) is fully protected from the exterior in order to prevent the entry of dirt or foreign elements which may affect the behavior thereof.

18. An assembly according to claim 17, further comprising at least one fixing washer (65', 65") which is internally fixed to one of the pieces (1, 7) through an area of the housing cavity of the torsion spring (6) by means of two fixing screws (67) which pass through two fixing holes (68) situated in said at least one fixing washer (65', 65") which also comprises at least two insertion holes (66) of different diameters which can receive a pin of the torsion spring (6).

19. The assembly according to claim 16, wherein the base piece (1) comprises a stop (18) which cooperates with another stop (30) of the upper piece (7) to limit the rotational angle between the base piece (1) and the upper piece (7).

* * * * *